United States Patent [19]

Osborne

[11] 4,130,995

[45] Dec. 26, 1978

[54] VMP RISER HORIZONTAL BEARING

[75] Inventor: Bodwell D. Osborne, Atherton, Calif.

[73] Assignee: Standard Oil Company (Indiana), Chicago, Ill.

[21] Appl. No.: 848,047

[22] Filed: Nov. 3, 1977

[51] Int. Cl.[2] ..... B63B 35/44

[52] U.S. Cl. ..... 405/224

[58] Field of Search ..... 61/86, 87, 88, 94, 95, 61/98, 102; 114/265; 175/7

[56] References Cited

U.S. PATENT DOCUMENTS

| | | | |
|---|---|---|---|
| 2,857,744 | 10/1958 | Swiger et al. | 61/87 |
| 3,572,272 | 3/1971 | Dixon et al. | 61/98 |
| 3,976,021 | 8/1976 | Blenkarn et al. | 61/89 |

*Primary Examiner*—Jacob Shapiro

*Attorney, Agent, or Firm*—John D. Gassett

[57] ABSTRACT

This invention relates to a Vertically Moored Platform which is a floating structure anchored only by essentially parallel and vertical elongated members such as riser pipes under tension. Up to 32 or more such riser pipes are connected between a floating structure and anchor means on the sea floor. Special riser pipes/jacket horizontal bearing assemblies are provided to transmit horizontal force between the riser pipes and the floating structure.

3 Claims, 8 Drawing Figures

VMP RISER HORIZONTAL BEARING

BACKGROUND OF THE INVENTION

1. Field of Invention

This invention relates to a floating structure from which drilling or production operations are carried out. It relates especially to a special horizontal bearing assembly for use with the riser pipes of a Vertically Moored Platform.

In recent years, there has been considerable attention attracted to the drilling and production of wells located in water. Wells may be drilled in the ocean floor from either fixed platforms in relatively shallow water or from floating structures or vessels in deeper water. The most common means of anchoring fixed platforms includes the driving or otherwise anchoring of long piles in the ocean floor. Such piles extend above the surface of the water and support a platform attached to the top of the piles. This works fairly well in shallow water, but as the water gets deeper, the problems of design and accompanying cost become prohibitive. In deeper water, it is common practice to drill from a floating structure.

In recent years, there has been some attention directed toward many different kinds of floating structures. One system receiving attention for mooring is the so-called Vertically Moored Platform. A Vertically Moored Platform may be defined as a marine buoyant structure for drilling wells and/or producing hydrocarbons therefrom and anchored by essentially parallel, vertical, and elongated members such as riser pipes. In the preferred form of a Vertically Moored Platform, the riser pipes are without slip joints and provide the only anchoring means for the Vertically Moored Platform. Such a platform is described in several patents, including U.S. Pat. No. 3,648,638, issued Mar. 14, 1972, Kenneth A. Blenkarn, inventor.

2. Prior Art

The invention of this application is an improvement over the Vertically Moored Platforms described in the prior art. Such patents on the Vertically Moored Platform do not describe nor claim the horizontal bearing described herein, which is very useful for transmitting horizontal force between the riser pipe and the jacket or leg of the Vertically Moored Platform through which the riser pipe extends vertically. There are, of course, numerous bearings described in the prior art and are commercially available. However, I know of none similar to that bearing claimed herein for use with a riser pipe anchoring a Vertically Moored Platform.

BRIEF DESCRIPTION OF THE INVENTION

In the preferred embodiment of the Vertically Moored Platform the only mooring or anchoring is done by riser pipes which extend from anchoring means in the ocean floor to within the buoyant structure. The buoyant structure in a Vertically Moored Platform normally comprises four buoyant legs. The metal shells making up the buoyant legs are normally referred to as "jackets" or "jacket legs". The riser pipes extend up in the inside of the jacket leg where they are secured in a vertical direction as shown in U.S. Pat. No. 3,976,021 by what may be termed vertical bearing. This is usually at the uppermost end of each riser pipe. Below the riser vertical bearings for the riser pipes, I provide horizontal bearings between the risers and the jacket leg to react the horizontal forces from the riser pipe bending into the jacket leg. These bearings are spherical and self-aligning which allow riser rotation without forcing secondary forces and moments into either the riser or jacket leg. The bearings are also designed so as to permit vertical movement between the riser pipe and the jacket leg.

A better understanding of the invention may be had from the following description taken in conjunction with the drawings.

DRAWINGS

DETAILED DESCRIPTION

Figure 1:
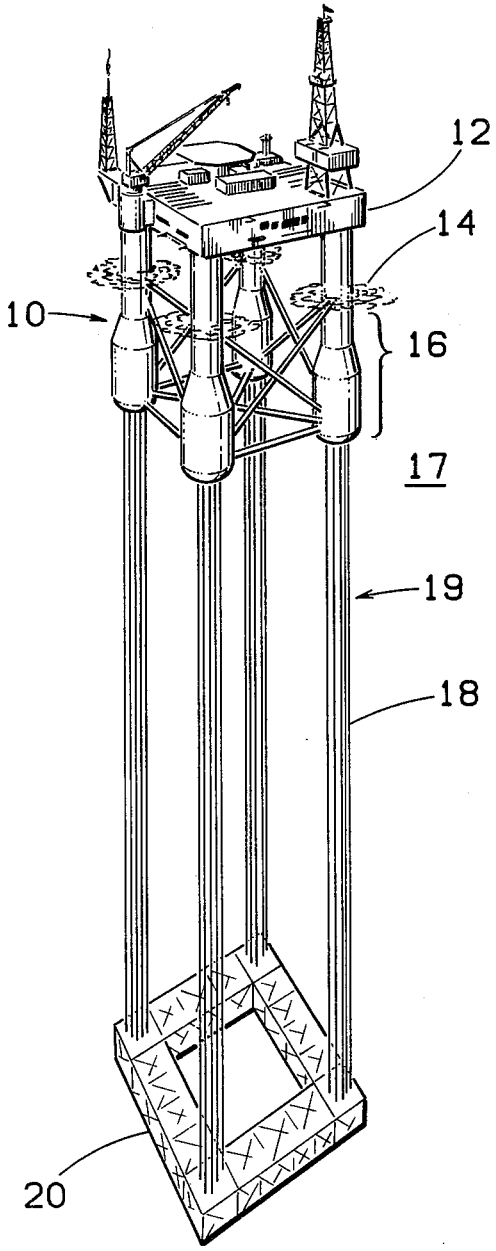
FIG. 1 illustrates a Vertically Moored Platform.

Attention is next directed to the drawings, and in particular FIG. 1 which illustrates a Vertically Moored Platform with an anchor such as a gravity base and riser installed and ready for drilling. There is shown a buoyancy means 10 supporting a deck or platform 12 above the surface 14 of the body of water 17. The buoyancy means 10 includes four jacket legs 16 which are bottle-shaped and form a shell-like structure. The buoyancy means 10 is connected to gravity base 20 by a plurality of legs 19. Each leg 19 includes a plurality of riser pipes 18. Gravity base 20 can be any convenient anchoring means. For example, the riser pipes 18 can be tied into or connected to casing set and cemented into the ocean floor. In any event, the particular anchoring means selected is not important in describing the present invention.

Figure 3:
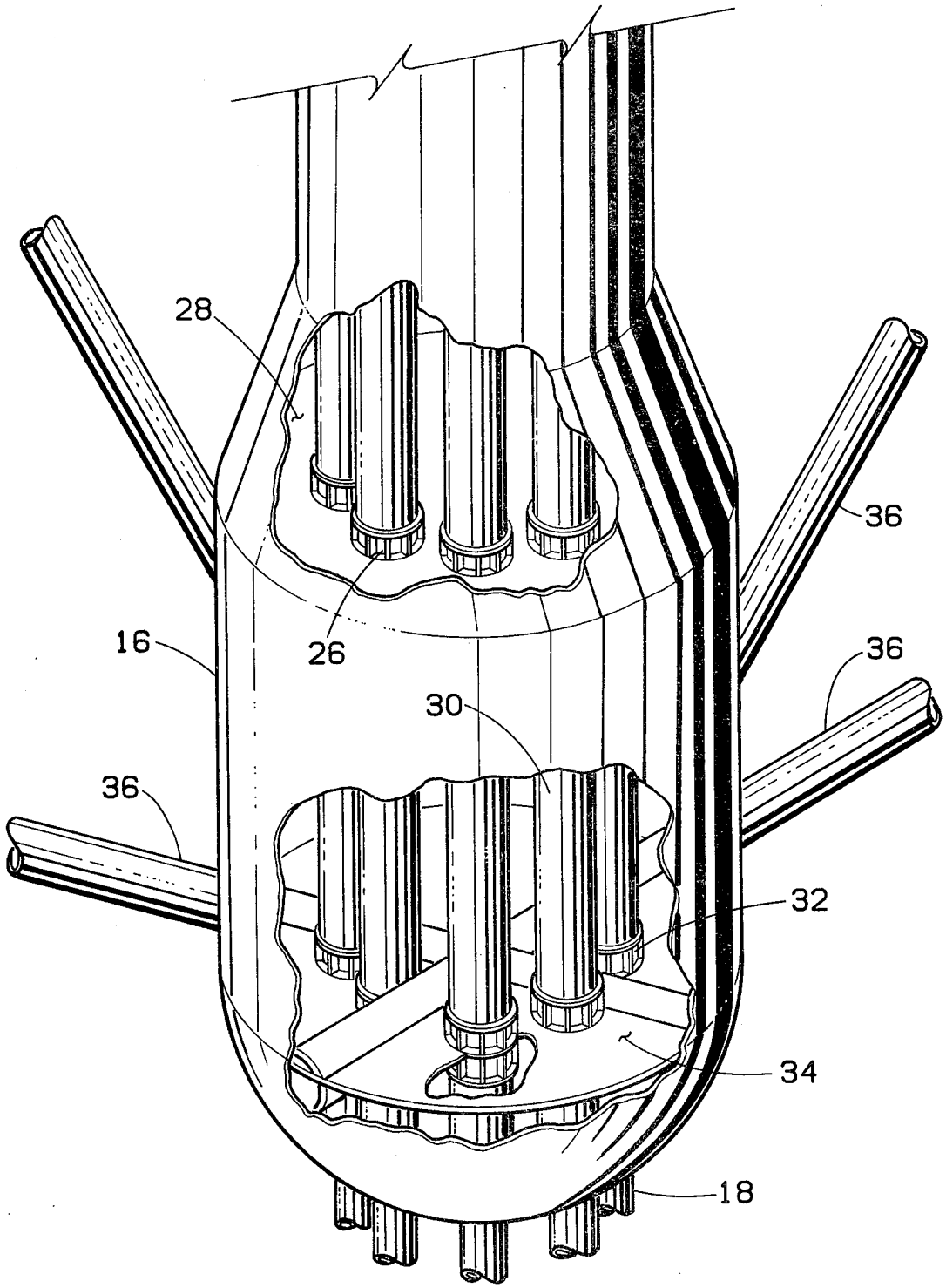
FIG. 3 illustrates one jacket leg of the Vertically Moored Platform of FIG. 1, in partial cut-a-way view showing the riser pipes and location of horizontal bearings therein.

Attention is next directed to FIG. 3 which shows one of the jacket legs 16 of FIG. 1 in enlarged view with a portion of the wall cut out. Jacket leg 16 is connected to the other jacket legs by bracing 36. Shown within jacket leg 16 is an upper diaphragm or bulkhead 28 and a lower bulkhead 34. The upper end of riser pipes 18 extends through openings in the upper and lower bulkheads. These bulkheads are really large, circular plates or sheets of steel, which may be as much as 2 inches thick, and are structural members to maintain the horizontal bearings and the risers in proper position. The bearing shells or stiffeners for the riser pipes are supported by these bulkheads. As can be seen, each riser pipe 18 has upper horizontal riser bearing 26 and a lower horizontal riser bearing 32.

In order to show some of the magnitude of the system shown in FIG. 1, the following are typical dimensions. Jacket leg 16 may be 60 feet (18.3 m) in diameter, riser pipes 18, 21 inches (53 m) in diameter, and the distance between upper horizontal riser bearing 26 and lower horizontal riser bearing 32 may be 60 feet (18.3 m) or more.

Figure 2:
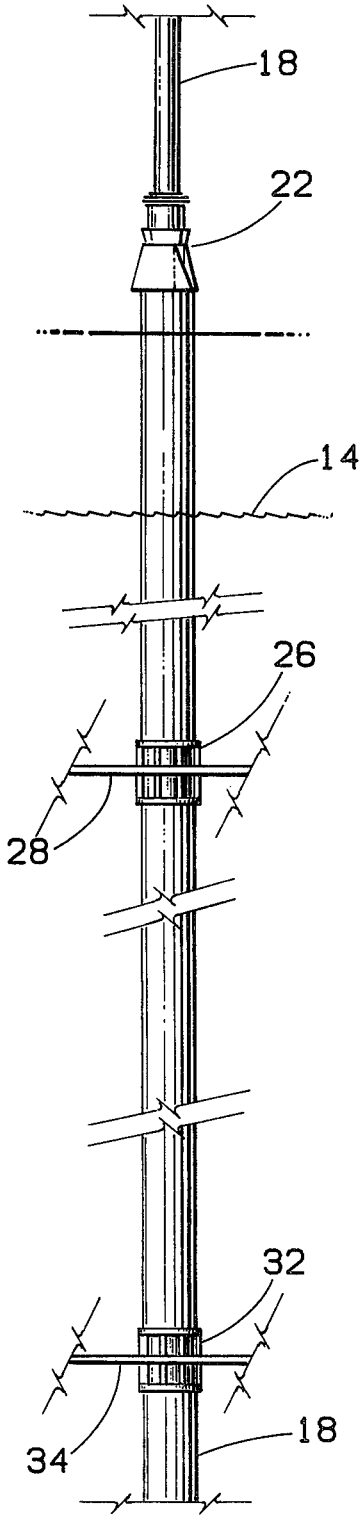
FIG. 2 illustrates the upper end of one riser pipe of FIG. 1, showing the position of a lower and an upper horizontal riser bearing.

Attention is next directed to FIG. 2 which illustrates the upper end of a riser pipe 18, extending through upper bulkhead 28 and lower bulkhead 34. Bearings 26 and 32 are both within the jacket leg 16. Mounted at the upper end of riser 18 is a vertical riser bearing 22. Details of a typical vertical riser bearing 22 are shown in U.S. Pat. No. 3,976,021, Blenkarn et al., issued Aug. 24, 1976. The portion of riser pipe 18 below vertical riser bearing 22 may have a thicker wall section than that part of the riser pipe 18 which extends above the vertical riser bearing 22.

Interior of jacket leg 16 are a plurality of riser sleeves 30 through which riser pipes 18 extend. This riser sleeve 30 may extend from the lower end of jacket leg 16 through bulkheads 28 and 34 to the vertical riser bearing 22.

Figure 4:
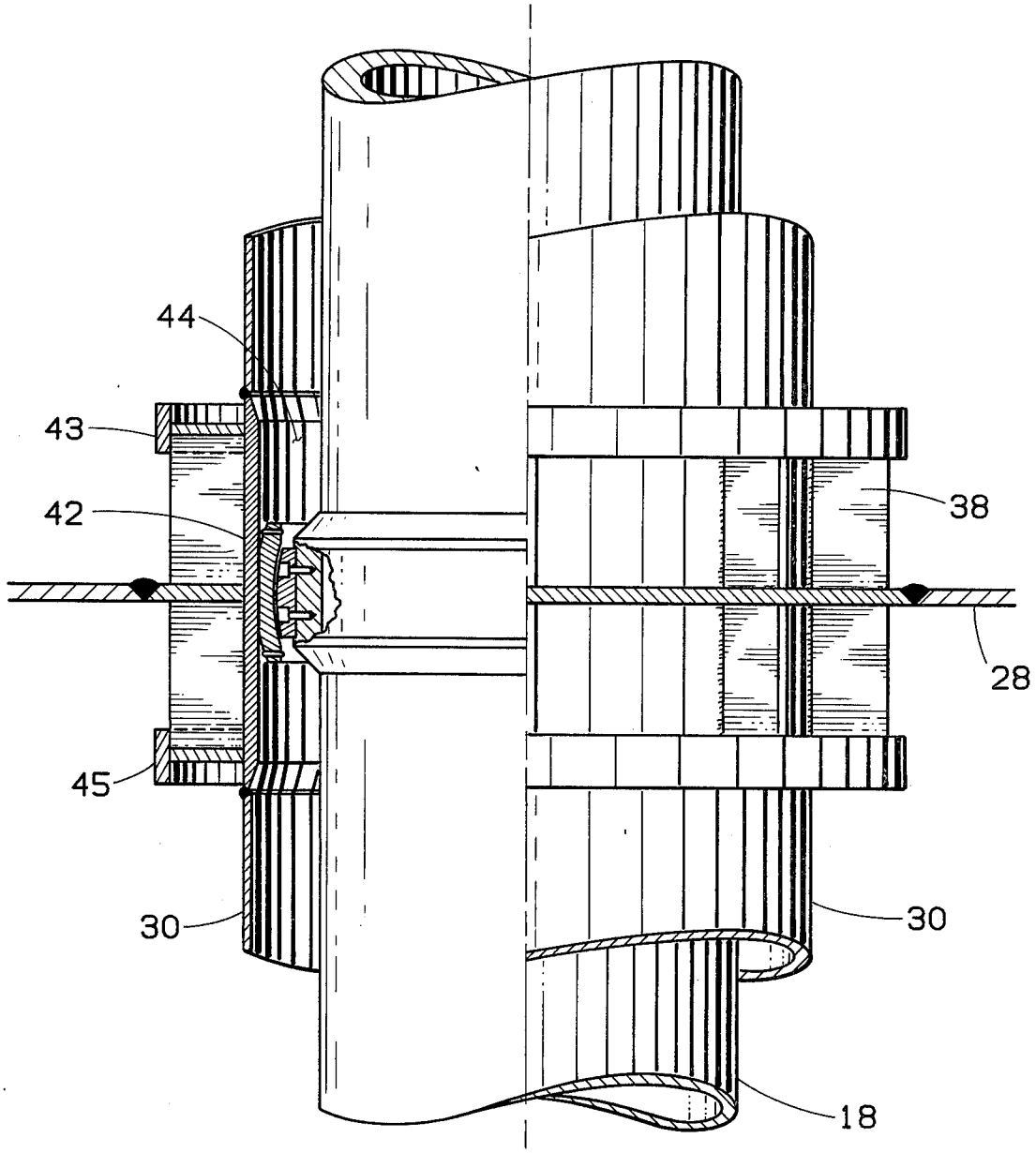
FIG. 4 is a view of the horizontal bearing and its relation with the riser and the jacket leg.

Attention is next directed to FIG. 4 to illustrate the relationship of the riser pipe 18, jacket leg 16, the horizontal bearings, and the bulkhead 28. Shown in FIG. 4 is a riser pipe 18 which is mounted within riser sleeve 30. Riser sleeve 30 is secured to bulkhead 28. This is for the upper horizontal bearing; however, the lower horizontal bearing would be connected in a similar manner. In other words, the riser sleeve 30 is an integral part and is fixed to the bottle or main jacket leg 16. The riser sleeve 30 is provided with a reinforced section 42 which can be a thickened wall section of sleeve 30 and extends from above to below bulkhead 28 and may be about 33 feet (10 m) in vertical length and about 1 inch (2.54 cm) in thickness. Upper stiffening ring 43 and a lower stiffening ring 45 connected by ribs 38 are provided and are attached to reinforced section 42. The interior of reinforced section 42 is provided with a hard-surfaced and finished area 44 which in reality is one bearing surface for the bearing in the vertical motion between the riser pipe 18 and the jacket leg.

Figure 5:
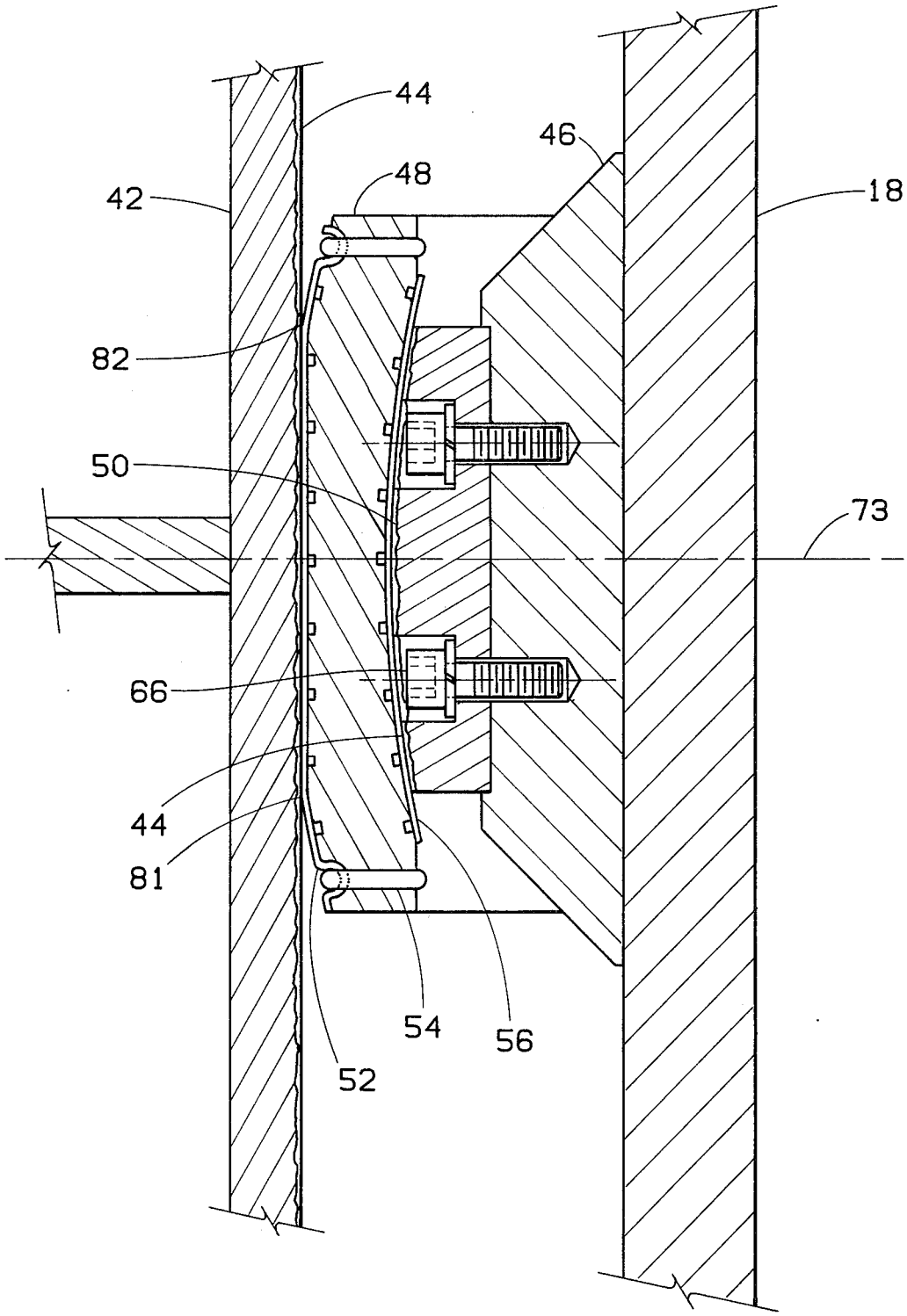
FIG. 5 is an enlarged view of the horizontal bearing.
Figure 6:
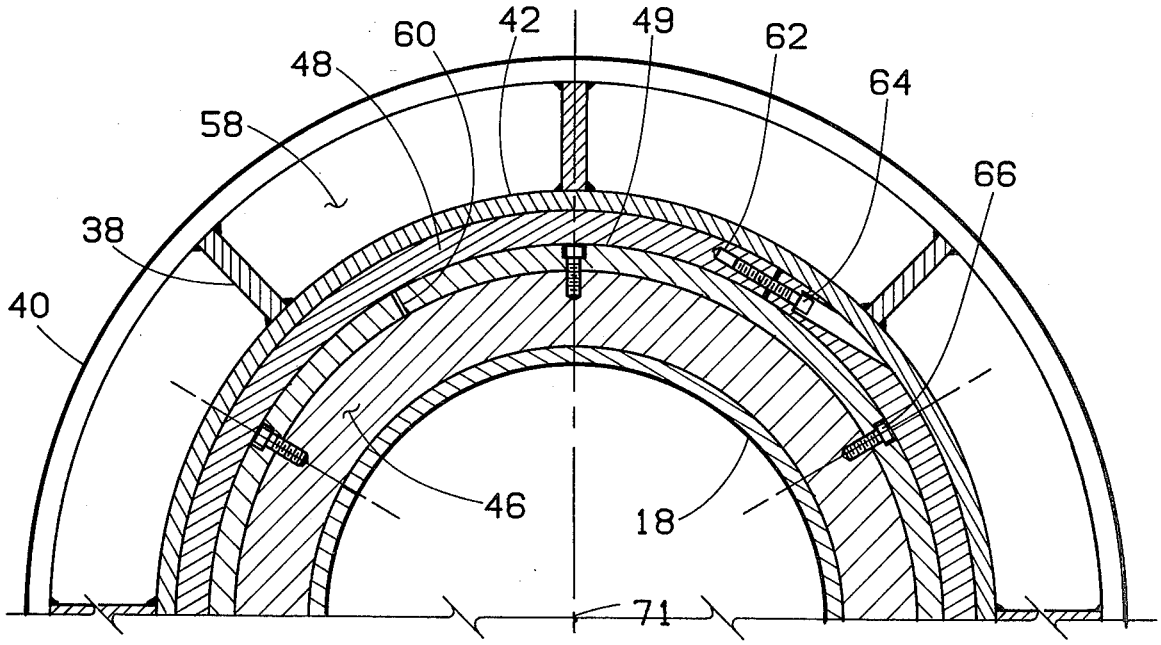
FIG. 6 is a horizontal sectional view of one half of a horizontal bearing in a jacket leg.

The horizontal bearing is thus between the interior of reinforced section 42 of the riser sleeve within jacket leg 16 and the exterior of the riser pipe 18. This is shown in FIG. 4, but it is shown in an enlarged and more detailed view in FIG. 5 to which attention is now directed. Shown in FIG. 5 is the inner hard-surface area 44 of riser jacket 42. A floating bearing 48 (female) is provided between the hardened surface 44 and the riser pipe 18. Descriptions of such bearing 48 and means for holding it in position will now be discussed. Mounted on the riser pipe 18 is collar or inner race 46, which may be heated and then shrunk to fit onto the riser pipe 18. Spherical bearing 49 is mounted on collar 46 by bolt 66. The bearing 49 can be made in two parts and fitted around the collar 46 within a groove of collar 46 as shown in a known manner. The outer surface 50 of spherical bearing 49 is made of a hardened, wear-resistant material. Outer surface 50 is defined as that portion of a sphere having a vertical center at point 71 as shown in FIG. 6, which is on center line of the riser pipe 18 and the horizontal center line 73 of FIG. 5. The floating bearing 48 is provided between spherical bearing 49 and hard surface 44 of the riser jacket. The inner surface of floating bearing 48 is concave and complements the outer surface of spherical bearing 49. The outer surface of floating bearing 48 is cylindrical and complements the inner surface 44 of the riser jacket. Floating bearing 48 is made in two parts and is assembled over spherical bearing 49 as by bolts 64 mounted in hole 62 as shown in FIG. 6. Only one such connection is shown; however, there is another such connection 180 degrees from bolt 64 and hole 62.

In order to reduce friction both the inner and outer surfaces of floating bearing 48 are preferably covered with Teflon, which is a trademark of E. I. du Pont de Nemours Co., signifying a synthetic resin polymer. The Teflon pad 52 can be held in position on bearing 48 by clips 54, for example. The inner surface of floating bearing 48 also has as its center center 71. A typical radius of the outer surface of spherical bearing 49 is 19.815 inches (appx. 50.330 cm) and a typical mating radius for the inner surface of floating bearing 48 is 19.895 inches (appx. 50.533 cm). A typical radius for outer surface of floating bearing 48 is 21.375 (appx. 54.293 cm) and a typical radius of the hardened surface 44 is 21.5 inches (appx. 54.61 cm). A typical length or dimension of the vertical portion between points 81 and 82 of the floating bearing 48 is about 7 feet (appx. 2.13 m).

There are two type movements between riser 18 and the jacket leg and particularly the stiffened section 42. This could be a vertical motion (i.e., longitudinal with respect to the axis of these members) or it can be a pivoting-type motion. This bearing arrangement takes care of each. The vertical movement can be between the bearing housing and the outer wall of floating bearing 48. This permits one to slide with respect to the other. Rotational movement between the riser and the jacket can be permitted or accommodated between the inner surface of floating bearing 48 and the outer surface of spherical bearing 49. Thus, inasmuch as these bearings are the spherical self-aligning type they will allow riser rotation without forcing secondary forces and moments into either the riser or jacket structure.

Figure 7:
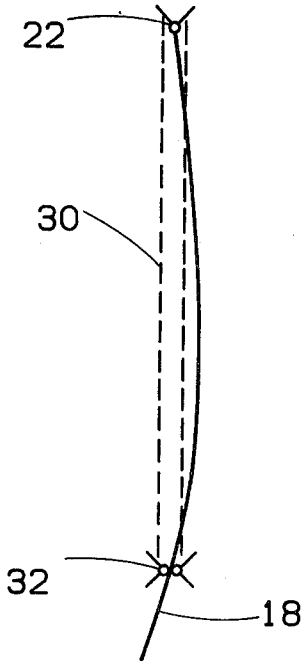
FIG. 7 illustrates the shape of the upper end of a riser pipe without an upper horizontal bearing.
Figure 8:
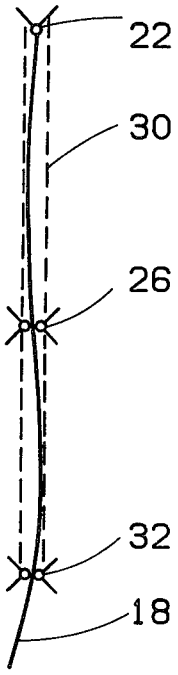
FIG. 8 illustrates the shape of the upper end of a riser pipe with both an upper and a lower horizontal bearing.

The importance of using both upper and lower horizontal bearings is indicated in FIGS. 7 and 8. The lateral deflection of riser 18 without upper horizontal bearing 26 would be as indicated in FIG. 7, assuming riser sleeve 30 were not in place. FIG. 8 indicates a changed and limited deflection of riser 18 between lower horizontal bearing 32 and vertical support bearing 22. The mathematics for determining lateral deflection of a vertically suspended pipe are well known. For example, for a beam-column, subject to applied bending moment and axial loads, the system can be described by the following differential equation:

$$\frac{d^2}{dx^2}\left[E(x)I(x)\frac{d^2y(x)}{dx^2}\right] + \frac{d}{dx}\left[P(x)\frac{dy(x)}{dx}\right] = 0.$$

where

E(x) = modulus of elasticity,

I(x) = moment of inertia,

P(x) = axial load, y(x) = lateral deflection, and x = location along the length of the beam column.

By applying the known boundary conditions of a system, the differential equation can be solved such as to satisfy all required conditions. Such required conditions can include stress level, lateral deflection limits, or structural section size and/or configuration.

While the above invention has been described in detail, various modifications can be made thereto without departing from the spirit or scope of the invention.

What is claimed is:

1. A structure for use with a buoyant structure which comprises:

a shell;

an upper plate in said shell;

a lower plate in said shell, each plate having a plurality of vertical holes therethrough;

riser pipes extending through said holes through each said plate;

bearing means supported in each said vertical hole between each said riser pipe and said plate, said bearing means including a male spherical bearing surrounding said riser pipe, the center of the sphere defined by the outer surface of said spherical bearing being on the center line of said riser;

a cylindrical bearing surface formed and supported by each said plate in said opening at the level of each said plate; and a floating bearing positioned between said cylindrical bearing and said spherical bearing, the inner surface of said floating bearing complementing the outer surface of said spherical bearing and the outer surface of said floating bearing complementing said cylindrical surface.

2. A structure as defined in claim 1 including:

a vertical sleeve extending through each said hole in each said plate and fixed thereto;

a plurality of stiffening rings, one mounted about and fixed to each said sleeve above each said plate and a second stiffening ring mounted below each said plate and fixed to each said riser; and a friction-reducing material fixed to said inner surface and said outer surface of said floating bearing.

3. A horizontal thrust bearing for use in a Vertically Moored Platform having a plurality of buoyant jacket legs for supporting a platform above the surface of a body of water and in which the Vertically Moored Platform is anchored to the bottom of the body of water with riser pipes which extend through said jacket legs, the improvement which comprises:

a spherical bearing of a ring-like configuration surrounding said riser pipe, the outer surface of said bearing defining a spherical member having a center on the center line of said riser pipe;

a cylindrical bearing supported by said jacket leg and its axis arranged in a vertical direction; and a floating bearing for mounting between said spherical bearing and said cylindrical bearing, the interior surface of said floating bearing complementing the exterior surface of said spherical bearing and the exterior surface of said floating bearing complementing said cylindrical bearing.

* * * * *